United States Patent [19]

Warren

[11] 3,937,909

[45] Feb. 10, 1976

[54] MULTIPLE CONTACT SWITCH

[76] Inventor: Jack L. Warren, P.O. Box 5784, Reno, Nev. 89502

[22] Filed: Nov. 1, 1974

[21] Appl. No.: 520,346

[52] U.S. Cl. ..... 200/16 C
[51] Int. Cl.[2] ..... H01H 15/00
[58] Field of Search..... 200/16 R, 16 C, 16 D, 61.1, 200/61.11, 76, 161, DIG. 29, DIG. 51, DIG. 54, DIG. 55

[56] References Cited

UNITED STATES PATENTS

| | | | |
|---|---|---|---|
| 1,696,902 | 1/1929 | Clerico | 200/161 |
| 1,961,146 | 6/1934 | Harrington | 200/DIG. 29 |
| 2,254,729 | 9/1941 | Bryant et al. | 200/76 X |
| 3,032,620 | 5/1962 | Siiberg | 200/DIG. 29 |
| 3,145,270 | 8/1964 | Brown | 200/16 C |
| 3,187,119 | 1/1965 | Dyksterhouse | 200/16 C |
| 3,757,060 | 9/1973 | Ianuzzi et al. | 200/16 C |

*Primary Examiner*—Herman Hohauser
*Attorney, Agent, or Firm*—Blair & Brown

[57] ABSTRACT

A multiple contact switch including an elongate contact member mounted for sliding movement. A pair of contact posts are positioned beneath the sliding contact member and a contact ball is arranged between the contact posts with the sliding contact member resting on the ball and moving the ball into contacting relation with the two posts. A third contact post has a cam surface and a sliding contact member has a cam surface adapted to cooperate with the cam surface of the post to lift the sliding contact member out of contact with the ball as the sliding contact member makes contact with the contact post having the cam surface.

5 Claims, 5 Drawing Figures

MULTIPLE CONTACT SWITCH

BACKGROUND OF THE INVENTION

Field of the Invention

The present invention relates to a multiple contact switch having a sliding contact member.

SUMMARY OF THE INVENTION

The present multiple contact switch includes a housing which is normally filled with oil and has a sliding contact bar mounted thereon with a cam element integrally formed on the free end of the bar. A pair of contact posts are positioned beneath the bar and out of contact with the bar and a contact ball is mounted for rolling action between the contact posts. The contact bar engages the ball and as the bar is reciprocated the ball is rolled from contact with one of the contact posts into contact with the other of the contact posts completing a circuit from the contact bar through the respective contact posts and the ball. A third contact post with cam surface is positioned to be engaged by the cam surface of the sliding contact bar so as to lift the sliding contact bar out of contact with the ball as a circuit is established through the contact bar and and the last contact post.

The primary object of the invention is to provide a positive acting multiple contact switch.

Other objects and advantages will become apparent in the following specification when considered in light of the attached drawings.

DESCRIPTION OF THE PREFERRED EMBODIMENT

Figures 1, 2, 3, 4, 5:
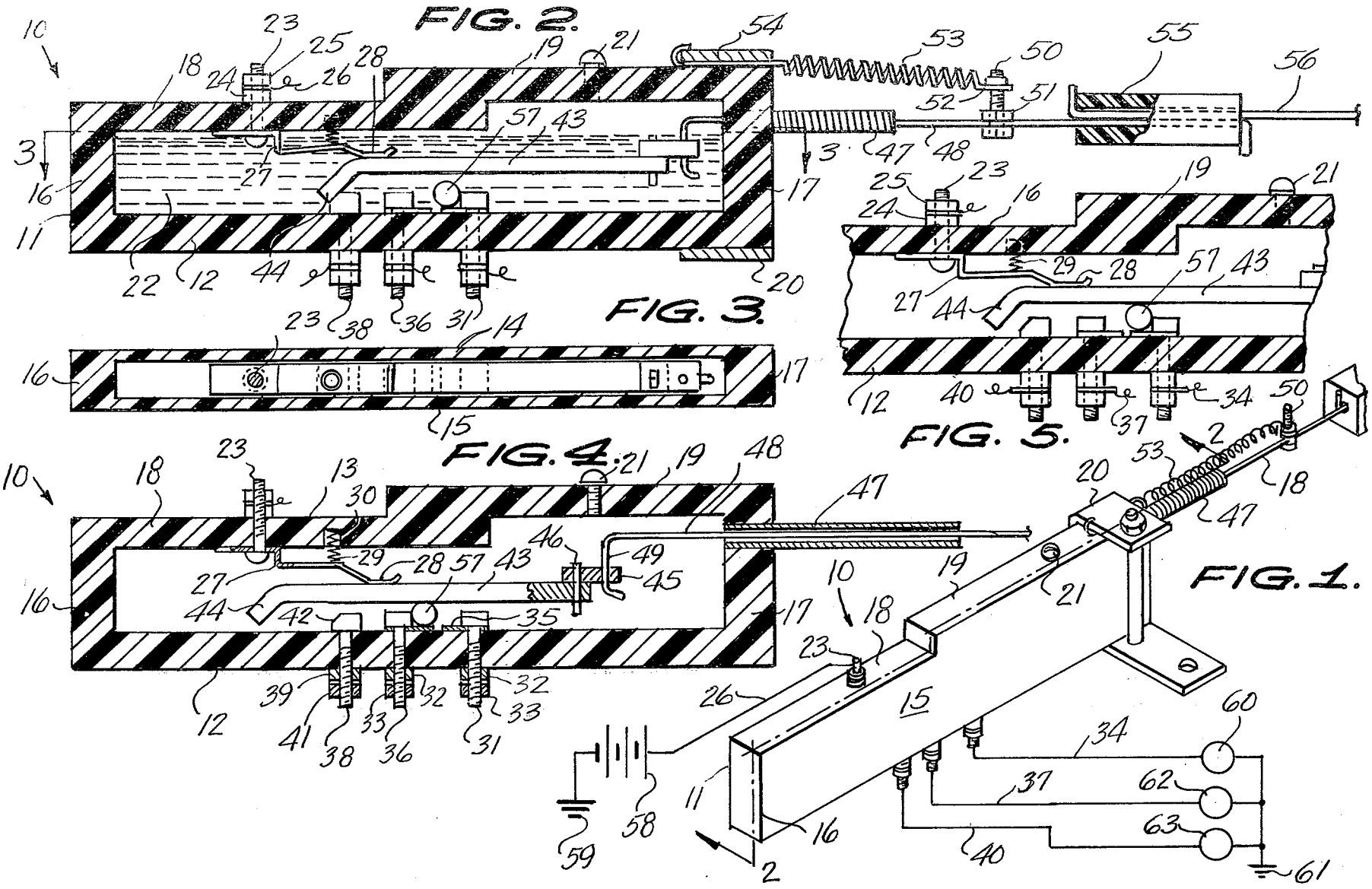
FIG. 1 is a perspective view of the invention.
FIG. 2 is an enlarged vertical sectional view taken along the line 2—2 of FIG. 1 looking in the direction of the arrows.
FIG. 3 is a horizontal sectional view taken along the line 3—3 of FIG. 2 looking in the direction of the arrows.
FIG. 4 is a view similar to FIG. 2 illustrating the switch in a second position.
FIG. 5 is an enlarged view similar to FIG. 2 illustrating the contacts in a third position.

Referring now to the drawings in detail wherein like reference characters indicate like parts throughout the several figures, the reference numeral 10 indicates generally a multiple contact switch constructed in accordance with the invention.

The multiple contact switch 10 includes a housing 11 having a bottom wall 12, a top wall 13, a rear wall 14, a front wall 15, end walls 16-17 and a pair of stepped top walls 18-19.

A generally U-shaped mounting bracket 20 encompasses one end of the housing 11 for mounting the multiple contact switch 10 in a desired location. A filler plug 21 extends through the top wall 19 for fillng the housing 11 with oil 22.

A contact bolt 23 extends upwardly through the top wall 18 and is secured in place by a nut 24. A second nut 25 on the contact bolt 23 is provided for clamping a wire 26 thereto.

A spring arm 27 is secured to the underside of the top wall 18 by the contact bolt 23 and has a shoe 28 on one end thereof for reasons to be assigned. A coil spring 29 is mounted in a socket 30 in the top wall 18 and engages the spring arm 27 to bias the shoe 28 downwardly toward the bottom wall 12.

A contact post 31 extends through the bottom wall 12 and is secured in place by a nut 32. A second nut 33 is threaded onto the bolt 31 to clamp a wire 34 thereto. The threaded post 31 has a contact plate 35 secured thereto and engaging against the bottom wall 12. A second contact post 36 identical to the contact post 31 also extends through the bottom wall 12 and is secured thereto by a nut 32 with a wire 37 secured thereto by a nut 33. A third contact post 38 extends through the bottom wall 12 and is secured thereto by a nut 39. A wire 40 is secured to the contact post 38 by means of a second nut 41. The contact post 38 has a cam surface 42 formed on the side thereof opposite the contact posts 31-36.

An elongate sliding contact bar 43 is positioned within the housing 11 and has a downwardly sloping cam finger 44 formed on one end thereof and adapted to engage the cam surface 42 of the contact post 38. An insulating coupler block 45 is secured to the opposite end of the contact bar 43 by a pin 46. A relatively short flexible cable housing 47 is secured to the end wall 17 of the housing 11 and a control wire 48 extends therethrough. A generally U-shaped end portion 49 is formed on the wire 48 engaging through the block 45 to permit reciprocating motion of the wire 48 to cause reciprocating motion of the contact bar 43.

A post 50 is secured to the wire 48 by a nut 51 to support the end 52 of a coil spring 53. A hook 54 on the opposite end of the coil spring 53 is secured to the housing 11 by means of the bracket 20. A coupler 55 couples the control wire 48 to a control wire 56 to permit the control wire 56 to move the contact bar 43 positively to the right as viewed in FIG. 2 with the contact bar 43 being returned in the opposite direction by the spring 53.

In the use and operation of the invention starting with the switch in the position illustrated in FIG. 2 the control wire 56 is moved to the left as viewed in FIG. 2 permitting the spring 53 to urge the control wire 48 to the left and thus the contact bar 43. As the contact bar 43 moves toward the left the pressure from the spring arm 27 through the shoe 28 keeps the cam finger 44 in contact with the cam surface 42 of the post 38 and the contact bar 43 moves downwardly until it comes in contact with a contact ball 57 positioned between the posts 31-36. As the contact bar 43 engages the ball 57 a circuit is established from the post 23 through the spring arm 27, contact bar 43, ball 57 and post 31.

The cam finger 44 moves out of contact with the contact post 38 breaking the circuit to the wire 40. Further movement of the contact bar 43 to the left as viewed in FIG. 2 causes the ball 57 to roll out of contact with the contact post 31 into contact with the contact post 36 to break the circuit through the wire 34 and make the circuit through the wire 37.

As the contact bar 43 moves between the extremities of its operation there will be brief instances when contact will be established through more than one of the contact posts 31-36 and 38.

In the circuit for the multiple contact switch 10 a battery 58 is connected from ground 59 to the contact post 23. A signal bulb 60 is connected to the wire 34 and the ground 61. A signal bulb 62 is connected to the wire 37 and to the ground 61 and a signal bulb 63 is connected to the wire 40 and to the ground 61.

The multiple contact switch 10 may be used for operating warning signal lamps in a motor vehicle, traffic lights, advertising signs, and similar devices.

Having thus described the preferred embodiment of the invention it should be understood that numerous structural modifications and adaptations may be resorted to without departing from the spirit of the invention.

What is claimed is:

1. A multiple contact switch comprising a housing, a sliding contact bar mounted in said housing and connected to an external source of power, means extending into said housing for reciprocating said contact bar, a pair of contact posts mounted in closely adjacent but spaced apart relation in said housing and having external electrical connections, a ball adapted for contact with either of said contact posts selectively, said contact bar engaging said ball to move said ball from contact with one of said contact posts to contact with the other of said contact posts and thus establish a connection between the contact bar, the external source of power, the contact posts and the external connections, and means extending into said housing engaging said contact bar for biasing said contact bar into engagement with said ball.

2. A device as claimed in claim 1 including a third contact post arranged adjacent to said first contact posts and spaced therefrom and having an external connection, means on said third contact post cooperating with means on said contact bar to raise said contact bar out of contact with said ball and thereby break electrical connection upon movement of said contact bar in one direction.

3. A device as claimed in claim 2 wherein said means includes a cam surface on said last named contact post and a cam finger integrally formed on said contact bar for moving along the cam surface on the contact post.

4. A device as claimed in claim 1 including spring means attached to the reciprocating means for resiliently moving said contact bar in one direction.

5. A device as claimed in claim 1 wherein the means biasing said contact bar toward said ball includes a contact shoe engaging said contact bar, a fourth contact post mounting the contact shoe on the housing, and means connecting the external source of power to the fourth contact post to thereby energize the contact bar.

* * * * *